US012788192B2

(12) United States Patent
Espín Franco et al.

(10) Patent No.: US 12,788,192 B2
(45) Date of Patent: Nov. 10, 2026

(54) TRANSPORT OF DIRT IN A SUCTION HEAD FOR USE IN A VACUUM CLEANER

(71) Applicant: VERSUNI HOLDING B.V., Eindhoven (NL)

(72) Inventors: Fermín Espín Franco, Eindhoven (NL); IJpe Bernardus Brada, Eindhoven (NL); Bastiaan Johannes De Wit, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 468 days.

(21) Appl. No.: 18/282,391

(22) PCT Filed: Mar. 9, 2022

(86) PCT No.: PCT/EP2022/056039
§ 371 (c)(1),
(2) Date: Sep. 15, 2023

(87) PCT Pub. No.: WO2022/194638
PCT Pub. Date: Sep. 22, 2022

(65) Prior Publication Data

US 2025/0127351 A1 Apr. 24, 2025

(30) Foreign Application Priority Data

Mar. 17, 2021 (EP) ..... 21163046

(51) Int. Cl.
*A47L 5/30* (2006.01)
*A47L 7/00* (2006.01)
*A47L 9/04* (2006.01)

(52) U.S. Cl.
CPC ..... *A47L 5/30* (2013.01); *A47L 7/0009* (2013.01); *A47L 9/0466* (2013.01)

(58) Field of Classification Search
CPC ..... A47L 5/30; A47L 7/0009; A47L 9/0466; A47L 9/0477
See application file for complete search history.

(56) References Cited

U.S. PATENT DOCUMENTS

2011/0180105 A1 7/2011 Moes
2017/0280957 A1 10/2017 Jeong et al.
(Continued)

FOREIGN PATENT DOCUMENTS

CN 208625596 U 3/2019
CN 211633112 U 10/2020
(Continued)

OTHER PUBLICATIONS

KR 102094660 B1 (machine translation) (Year: 2020).*
Extended European Search Report issued in connection with corresponding EP Application No. 21163046.2 dated Aug. 19, 2021.

*Primary Examiner* — Andrew A Horton
(74) *Attorney, Agent, or Firm* — Maschoff Brennan

(57) ABSTRACT

In a suction head including a housing and at least one rotatable brush for interacting with a surface to be cleaned, a surface of the housing is provided with a plurality of grooves for facilitating transport of dirt towards an outlet opening in the surface from any position along the brush. The plurality of grooves has two sets of grooves, which are located at opposite sides of the outlet opening. Taking a rotation axis of the brush as a reference, each of the sets of grooves includes grooves having a circumferential component and an axial component, whereof, as seen in the same circumferential direction, a direction of the axial component of the grooves is opposite for the two sets of grooves.

14 Claims, 5 Drawing Sheets

(56) References Cited

U.S. PATENT DOCUMENTS

| | | | | |
|---|---|---|---|---|
| 2020/0069137 | A1* | 3/2020 | Nguyen | A47L 11/4075 |
| 2020/0121144 | A1 | 4/2020 | Gacin et al. | |

FOREIGN PATENT DOCUMENTS

| | | | |
|---|---|---|---|
| DE | 202009013434 | U1 | 12/2009 |
| FR | 1068296 | A | 6/1954 |
| KR | 101006013 | B1 | 1/2011 |
| KR | 102094660 | B1 | 3/2020 |
| RU | 2543427 | C2 | 2/2015 |
| WO | 2011083373 | A1 | 7/2011 |
| WO | 2012107876 | A1 | 8/2012 |
| WO | 2017071727 | A1 | 5/2017 |
| WO | 2018024660 | A1 | 2/2018 |

* cited by examiner

TRANSPORT OF DIRT IN A SUCTION HEAD FOR USE IN A VACUUM CLEANER

CROSS-REFERENCE TO RELATED APPLICATIONS

The present application is a U.S. National Phase application under 35 U.S.C. § 371 of International Application No. PCT/EP2022/056039, filed on Mar. 9, 2022, which claims the benefit of European Patent Application No. 21163046.2, filed on Mar. 17, 2021. These applications are hereby incorporated by reference herein.

FIELD OF THE INVENTION

The invention relates to a suction head configured to be applied in a vacuum cleaner and to perform a cleaning action on a surface, the suction head comprising: a housing, and at least one brush that is arranged in the housing to be rotatable about a rotation axis, and that is configured to interact with the surface to be cleaned, wherein the housing is configured to expose a portion of the brush to the surface to be cleaned and to cover another portion of the brush, and wherein a surface of the housing facing the brush is provided with an outlet opening that is configured to be in communication with an air suction source configured to invoke a flow of air in a direction away from an area of the housing where the brush is located, through the outlet opening.

Further, the invention relates to a cordless vacuum cleaner comprising a suction head as mentioned. In an embodiment, the suction head as mentioned is equipped with a wetting arrangement that is configured to enable a supply of liquid to at least one area of the surface to be cleaned and/or at least one area in the suction head, and the invention also relates to a wet vacuum cleaner comprising a suction head according to such embodiment.

BACKGROUND OF THE INVENTION

Vacuum cleaners are known for removing dirt from a surface to be cleaned. The term "dirt" as used in the present text is to be understood so as to cover any contamination as may be present on a surface and that can be removed under the influence of a vacuum cleaning action, probably combined with another cleaning action such as mopping. Practical examples in this respect include dust and small particles of any kind, and also wet types of contamination such as spilled drinks. A practical example of the surface to be cleaned is a floor, wherein the floor may be of any kind, such as a wooden floor, a carpet floor, a tile floor, etc.

Generally, a vacuum cleaner has a vacuum cleaner head or suction head, which is the part of the vacuum cleaner where the actual process of picking up dirt from a surface to be cleaned is to take place and which is therefore to be put on or at least close to the surface. Further, a vacuum cleaner normally comprises a body portion including a dirt accumulating area, and an arrangement configured to act on the suction head so that a suction force is prevailing in the suction head during operation of the vacuum cleaner. The suction force serves to facilitate transport of dirt that is picked up from the surface during operation of the vacuum cleaner towards the dirt accumulating area, wherein the dirt is made to pass an outlet opening in a housing of the suction head. The suction force may also have a function in the actual process of picking up the dirt from the surface. On the other hand, the suction head may be equipped with at least one movable component for interacting with the surface in order to pick up the dirt, such as at least one rotatable brush that may serve as an agitator of the dirt and that may particularly be configured to help dislodge dirt from the surface and direct it towards the outlet opening.

WO 2011/083373 A1 discloses a cleaning device for removing particles from a surface, comprising spraying means for spraying droplets of a work fluid, a rotatable brush having flexible brush elements, an inlet for receiving dirtied air such as air laden with particles, and a cleansing unit. The cleansing unit is suitable for separating at least a portion of the droplets of work fluid from the air. During operation, the rotatable brush is wetted by the work fluid. The brush is of such a dimension and is rotated at such a rotational speed that the droplets of the work fluid are expelled as a mist of droplets from the flexible brush elements into a coalescing space of the device. The dirtied air received by the inlet is receivable by the coalescing space, to form coalesced particles of the droplets expelled from the brush elements and particles in the dirtied air, the coalesced particles being conveyable from the coalescing space to the cleansing unit.

WO 2012/107876 A1 discloses a cleaning device comprising a head having an open side for facing surfaces to be cleaned, and at least one brush for contacting surfaces to be cleaned, which is rotatably arranged in the head. The at least one brush is provided with a plurality of brush hairs, wherein it is possible that these brush hairs are extremely soft and flexible. In such a case, a cleaning action of a surface is not performed by scrubbing the surface but by putting the brush hairs alternately in and out of contact with the surface during rotation of the brush. In particular, during one revolution of the brush, the brush hairs remove particles and/or liquid droplets from a soiled surface and fling away the particles and/or the droplets when they reach a position in which they are free from contact to the surface and in which they can be fully outstretched. In the head of the cleaning device, in which the brush is arranged, there are means for receiving the particles and/or the droplets, and for possibly transporting the particles and/or the droplets towards a space where they are collected. The cleaning device may be equipped with means for realizing a suction force at the head in order to direct the particles and/or the droplets in a desired direction once they are released from the brush hairs. Further, it is possible that the cleaning device is configured to supply a cleaning liquid to the rotating brush in order to promote the adherence of particles to the brush hairs and/or to realize an additional cleaning effect on a surface to be cleaned.

WO 2017/071727 A1 discloses a vacuum cleaner head comprising a housing having a vacuum extraction zone and first and second rollers configured to locate against a surface to be cleaned, wherein each of the first and second rollers is configured to pick-up dirt from the surface and carry the dirt to the vacuum extraction zone in the housing of the vacuum cleaner head when being rotated and moved over the surface during operation. The vacuum extraction zone is defined between the outlet opening and the first and second rollers. When the vacuum cleaner head is used in a vacuum cleaner and the vacuum cleaner is operated, an airflow is generated through the vacuum extraction zone to the outlet opening.

It is understood that in the context of a suction head comprising at least one brush that is rotatable about a rotation axis that extends more or less parallel to a surface to be cleaned when the suction head is in a normal operation position relative to the surface, it is desired to pick up dirt from a surface to be cleaned independent of the position of the dirt in a longitudinal direction being the direction in which the rotation axis of the brush extends. In general, a dimension of the brush in the longitudinal direction, which will hereinafter referred to as the length of the brush, is considerably larger than a diameter of the suction outlet of the suction head. A common solution aimed at ensuring that the dirt is transported from the position where it enters the suction head to the outlet opening and beyond involves having a design of the suction head in which the cross-section of the suction channel has an elongated appearance, extending along (almost) the entire length of the brush. The common solution further involves taking measures aimed at having a relatively strong airflow in the suction head despite the relatively large dimension of the outlet opening. For this reason, the common solution is not preferred in the context of suction heads which are to be used in battery-operated vacuum cleaners, i.e. in vacuum cleaners in which highly efficient use of electric energy is of importance. A practical example of such vacuum cleaners is the so-called stick vacuum cleaners, which are getting more and more popular.

US 2020/121144 A1 discloses an agitator for use in a surface cleaning head of a vacuum cleaner. In an embodiment of the surface cleaning head, at least one rib extends within the surface cleaning head for engaging the agitator such that fibrous debris can be urged towards one or more predetermined locations on the agitator. The at least one rib can extend transverse to a longitudinal axis of the agitator such that, as fibrous debris becomes entangled around the agitator, the fibrous debris engages the rib and is urged towards a predetermined location along the agitator.

US 2017/280957 A1 discloses a suction nozzle apparatus comprising a drum brush arranged in a casing of the apparatus. In an embodiment of the apparatus, the drum brush includes a drum core and a plurality of rubber blades coupled to an outer circumference of the drum core in a spiral direction. To effectively move a foreign substance wound around a rubber blade to a gap formed in the drum core, a projection is formed in a spiral direction in a surface of a lower portion of the casing surrounding the drum brush, which projection functions to support the rubber blade and guide the rubber blade to the gap formed in the drum core.

SUMMARY OF THE INVENTION

In the context of a suction head comprising a housing and at least one rotatable brush arranged in the housing, it is an object of the invention to provide a possibility of having both a suction channel of limited size, i.e. of limited dimension as seen in the longitudinal direction, and at the same time applying a suction force that can be classified in the field as being relatively moderate or even low, without compromising on dirt build-up on a surface of the housing facing the brush.

In view of the foregoing, the invention provides a suction head configured to be applied in a vacuum cleaner and to perform a cleaning action on a surface, the suction head comprising: a housing, and at least one brush that is arranged in the housing to be rotatable about a rotation axis, and that is configured to interact with the surface to be cleaned, wherein the housing is configured to expose a portion of the brush to the surface to be cleaned and to cover another portion of the brush, wherein a surface of the housing facing the brush is provided with an outlet opening that is configured to be in communication with an air suction source configured to invoke a flow of air in a direction away from an area of the housing where the brush is located, through the outlet opening, wherein the surface of the housing facing the brush is further provided with a plurality of grooves, wherein the plurality of grooves comprises two sets of grooves, which are located at sides of the outlet opening which are opposite sides in a longitudinal direction being the direction in which the rotation axis of the brush extends, wherein each of the sets of grooves includes grooves which are oriented with a circumferential component about the rotation axis and with an axial component in the longitudinal direction, wherein, as seen in the same circumferential direction about the rotation axis, a direction of the axial component of the grooves of the one set of grooves is opposite to a direction of the axial component of the grooves of the other set, and wherein a distance between the surface of the housing facing the brush and an operational outline of the brush is a distance in a range of 0 mm to 2 mm, in areas of the surface of the housing facing the brush outside of the grooves.

It follows from the foregoing definition of the suction head according to the invention that the surface of the housing facing the brush is provided with both an outlet opening and a plurality of grooves, and that the plurality of grooves comprises two sets of grooves, which are located at opposite sides of the outlet opening as seen in the longitudinal direction. In particular, each of the sets of grooves includes grooves which are oriented with a circumferential component about the rotation axis and with an axial component in the longitudinal direction. As seen in the same circumferential direction about the rotation axis, a direction of the axial component of the grooves of the one set of grooves is opposite to a direction of the axial component of the grooves of the other set. Thus, the two sets of grooves may be classified as being opposite to each other as far as their axial configuration is concerned. For the sake of clarity, it is noted that the axial component of the orientation of the grooves is the component in the longitudinal direction, as indicated. This means that a groove that is oriented with an axial component of zero is a groove that extends in an imaginary plane that is perpendicular to the longitudinal direction, i.e. a groove that extends without inclination about the rotation axis. Further, for the sake of clarity, it is noted that in case the suction head comprises more than one brush and the plurality of grooves is designed to cover each of the brushes, the plurality of grooves comprises two sets of grooves per brush.

By providing the two sets of grooves as mentioned, a defined transport path of dirt that is flung from the brush and ends up at a position on the surface of the housing facing the brush is obtained, which is suitable to promote advancement of the dirt towards the outlet opening, utilizing the rotation movement of the brush. The two sets of grooves are configured to receive dirt from the rotating brush during operation of the suction head and to enable advancement of the dirt towards the outlet opening under the influence of the rotating brush. In the process, the opposite axial configuration of the two sets of grooves allows for enabling the advancement of the dirt as mentioned in opposite axial directions, i.e. from the opposite sides of the outlet opening where the sets of grooves are present towards the outlet opening, despite the fact that the rotation direction of the brush is the same at the position of both sets of grooves.

At least a number of elements of the brush have sufficient operational length to bring about movement through a groove of a dirt particle of certain size, i.e. a coarse dirt particle, as may be present in the groove under the influence of the rotation movement of the brush. In particular, a distance between the surface of the housing facing the brush and an operational outline of the brush is a distance in a range of 0 mm to 2 mm, in areas of the surface of the housing facing the brush outside of the grooves. When the coarse dirt particle has reached what is the end of a groove in the circumferential direction, the dirt particle is swept out of the groove on the basis of the flow that is induced by the rotating brush and is moved towards a next groove via the surface to be cleaned. Thus, under the influence of the rotation movement of the brush, the coarse dirt particle is alternately moved through a groove in the surface of the housing facing the brush and through a space that is not covered by the housing until it finally reaches the outlet opening, wherein the dirt particle comes closer to the outlet opening during the times that the movement of the dirt particle is directed by a groove. It is to be noted that in the context of the invention, a suction head is provided in which elements of the brush do not reach into the grooves, as follows from the above explanation in respect of the range of the distance between the surface of the housing facing the brush and the operational outline of the brush.

It follows from the foregoing that according to the invention, facilitation of transport of dirt picked up by the brush from a surface to be cleaned during operation to the outlet opening is achieved on the basis of a mechanical measure, namely a measure involving having grooves in the surface of the housing facing the brush. As an advantageous consequence, when it comes to ensuring that dirt is transported from the position where it enters the suction head to the outlet opening and beyond, there is no need for applying the above-mentioned conventional solution which relies on having an outlet opening that extends along (almost) the entire length of the brush and having relatively high suction power. This renders the invention suitable for application in the field of battery-operated vacuum cleaners. In this respect, it is noted that in a preferred embodiment of the suction head according to the invention, the outlet opening is dimensioned to cover only a portion of a dimension of the brush in the longitudinal direction. For example, a criterion may be that a length of a portion of the brush that is exposed to the outlet opening is between 0.8 and 1.3 times a diameter of the brush. On the basis of the outlet opening having only limited length, it is achieved that a drop of air speed is kept in an acceptable range and that transport of dirt particles and liquid droplets through the outlet opening and a suction channel to which the outlet opening provides access is not hampered by a lower speed of air, liquid and debris. Moreover, this allows for having a shape of the suction channel that is advantageous as far as prevention of deposition of dirt on a wall of the suction channel is concerned.

It is practical if in the longitudinal direction, the outlet opening has a substantially central positioning relative to the brush, so that a distance from the outlet opening to an extremity of the brush is substantially the same at both sides of the outlet opening and a dirt particle can be picked up under the influence of similar forces at either extremity.

In order to have optimal effect of the concept of having grooves in the surface of the housing facing the brush, it is preferred if, in the longitudinal direction, the plurality of grooves covers most or all of the brush. Further, it may be practical if the surface of the housing facing the brush covers the brush along an angular distance of at least 180° in the circumferential direction, and if the plurality of grooves covers most of the surface of the housing facing the brush in the circumferential direction. Preferably, the angular distance is even longer as a longer angular distance involves faster displacement of the dirt towards the outlet opening on the basis of an enhanced effect of each revolution of the brush on the dirt.

As mentioned in the foregoing, the two sets of grooves may be classified as being opposite to each other as far as their axial configuration is concerned. In this respect, it is noted that it may particularly so that the two sets of grooves are mirror-symmetrical relative to an imaginary mirror plane that is perpendicular to the rotation axis of the brush and that intersects the outlet opening.

The sets of grooves can have any appearance that is appropriate when it comes to the functionality of promoting advancement of dirt towards the outlet opening under the influence of the rotation movement of the brush. According to one practical example, at least one of the sets of grooves includes grooves which are arranged like segments of a helical winding about the rotation axis of the brush leading towards the outlet opening as seen in a direction of rotation of the brush about the rotation axis. A helical winding is known as a continuous winding comprising loops which are oriented according to a wire wound around a cylinder in an advancing fashion as it were, i.e. as a winding having a screw-like appearance. According to another practical example, at least one of the sets of grooves includes grooves which are arranged like segments of an elliptical winding about the rotation axis of the brush leading towards the outlet opening as seen in a direction of rotation of the brush about the rotation axis. An elliptical winding is known as a winding of which the loops are oriented according to parallel slices of a cylinder as it were, taken at an angle relative to the longitudinal axis of the cylinder, so that the loops are separate from each other.

The invention covers many possibilities of the dimensioning and the shape of the grooves. In general, it is advantageous if the grooves are configured such that dirt particles are prevented from escaping from the grooves, that the energy needed to transport dirt particles towards the outlet opening is minimized, that the time that the dirt particles move through a set of grooves is optimized, and/or that the extent that the suction head can get polluted by fine dust is minimized, to mention some of the factors that may contribute to optimal functioning of the suction head in terms of large transporting effect on dirt particles at relatively low suction power. In this respect, it is noted that according to the invention, advantageous effects may be obtained if:

individual grooves are configured to cover a distance in the longitudinal direction that is larger than the sum of a dimension of an individual groove in the longitudinal direction and a distance between individual grooves in the longitudinal direction, so that dirt particles can actually be transported from one groove to another, wherein it may particularly be so that individual grooves are configured to cover a distance in the longitudinal direction that is between two times and ten times the sum of the dimension of an individual groove in the longitudinal direction and the distance between individual grooves in the longitudinal direction, individual grooves have a saw tooth geometry with a steep saw tooth side and a shallow saw tooth side, so that the steep saw tooth side may support the particle transporting functionality of the grooves while the shallow saw tooth side may allow creation of a pocket that is large enough to contain the dirt particles while at the same time preventing the particles from getting stuck in the grooves and enabling good cleaning of the grooves, wherein it is practical if, as seen in the longitudinal direction, the grooves are open towards the outlet opening, i.e. if the shallow saw tooth side is more to the side of the outlet opening and the steep saw tooth side is in a position of facing the outlet opening, in the case that the individual grooves have a saw tooth geometry with a steep saw tooth side and a shallow saw tooth side, indeed, in the cross-section of an individual groove, the steep saw tooth side is at an angle that is in a range of 0° to 45° relative to an imaginary reference plane perpendicular to the longitudinal direction and/or the shallow saw tooth side is at an angle that is in a range of 45° to 85° relative to an imaginary reference plane perpendicular to the longitudinal direction, a depth of the grooves is in range of 0.5 mm to 4 mm, so that the grooves can be deep enough to guide the dirt particles but not so deep that the air speed in the grooves would drop too much or that dirt would accumulate, and/or the distance between individual grooves in the longitudinal direction is in a range between zero and a distance covered by the groove in the circumferential minus a dimension of an individual groove in the longitudinal direction, so that the chance that a dirt particle will move from one groove to a groove closer to the outlet opening is increased, the chance that a dirt particles escapes from a groove is minimized, and a friction force exerted on a moving dirt particle can be kept in an acceptable range.

In the context of the invention, the at least one brush may be of any type that is suitable to be used for picking up dirt from a surface to be cleaned. The brush may especially be designed to serve as an agitator, for example, agitating dirt particles as may be present on the surface. In a practical embodiment of the suction head according to the invention, the brush comprises a core element and flexible microfiber elements arranged on the core element. In such a brush, a linear mass density lower than 150 g per 10 km may be applicable to the microfiber elements, or at least tip portions thereof, so that the microfiber elements really can be highly flexible. The linear mass density as mentioned may even be lower than 10 g per 10 km, 5 g per 10 km or 1 g per 10 km. Such microfiber elements can be placed on the core element in a dense arrangement so as to very effectively interact with a surface to be cleaned during operation of the suction head. Further, it may be practical if such microfiber elements are arranged on the core element in tufts. When the brush is equipped with flexible microfiber elements, indeed, the operational outline of the brush is to be understood so as to be the outline of the brush with the microfiber elements in fully outstretched condition.

It is practical if an operational shape of the brush is generally the shape of a cylinder having a circular periphery, in other words, if the operational shape of the brush is generally the shape of a roller, which may be an elongated roller. At least a number of elements of the brush may be dimensioned so as to be capable of touching the surface of the housing facing the brush, in areas of the surface of the housing facing the brush outside of the grooves and possibly also inside the grooves, so as to have a cleaning effect on the surface of the housing facing the brush.

On the basis of the foregoing, the following overview of the way in which the grooves act to transport dirt is provided:

In the case that the at least one brush comprises flexible microfiber elements arranged on a core element, liquids can be transported by means of those microfiber elements. Liquid drops are projected from the rotating brush to the surface of the housing facing the brush and then guided by the groove geometry. The airflow created by the rotation of the brush in the space between the brush and the housing contributes to realizing movement of liquids in the grooves.

Coarse particles are transported under the influence of forces induced by the rotation of the at least one brush and guided by the groove geometry.

Small particles are transported by means of the microfiber elements. Small particles can also be transported by interacting with other particles, by the airflow created by the rotation of the brush in the space between the brush and the housing, and by interacting with liquids.

The above scenarios may occur independently from each other or in interaction with each other. The surface facing the at least one brush remains clean as a result of the discharge of dirt towards the outlet opening by means of the groove geometry. If the surface is arranged so as to cover the brush at only a minimal distance, the suction force is effectively invoked in the suction head, as a result of which air speed along the surface can be relatively high, which also contributes to keeping the surface clean, besides the fact that there is practically no room where dirt might build up.

The invention covers an embodiment of the suction head in which the suction head is equipped with a wetting arrangement that is configured to enable a supply of liquid to at least one area of the surface to be cleaned and/or at least one area in the suction head. In this respect, it is noted that the invention relates to a wet vacuum cleaner that comprises such a suction head.

The invention further relates to a vacuum cleaner, particularly a cordless vacuum cleaner, comprising a suction head as defined and described in the foregoing, in which the surface of the housing facing the brush is provided with a plurality of grooves.

The above-described and other aspects of the invention will be apparent from and elucidated with reference to the following detailed description of a practical embodiment of a suction head comprising a housing and two brushes arranged in the housing, in which the surface of the housing facing the brushes is provided with a plurality of grooves.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
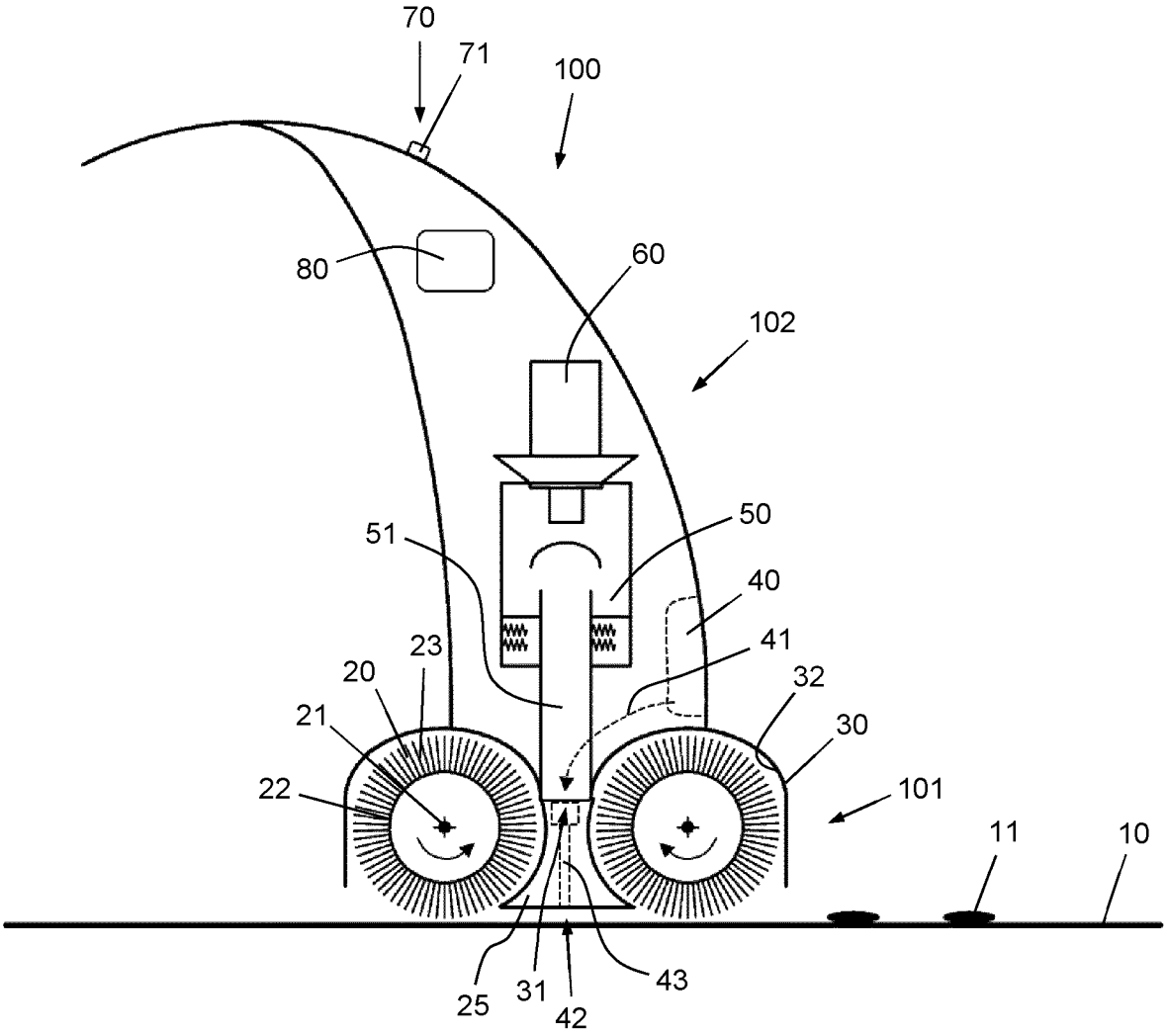
FIG. 1 diagrammatically shows components of a wet vacuum cleaner according to an embodiment of the invention and a portion of a floor having a surface to be cleaned, FIGS. 2 and 3 diagrammatically show a bottom view and a perspective view, respectively, of a suction head according to an embodiment of the invention, with two brushes which are included in the suction head being removed, FIG. 4 diagrammatically shows a flat surface projection of a portion of a surface of a housing that is provided with a plurality of grooves.

FIG. 1 illustrates the design of a wet vacuum cleaner 100 according to an embodiment of the invention. The particular vacuum cleaner represented in FIG. 1 and described in the following is just one example of many types of vacuum cleaners which are feasible in the framework of the invention. In this respect, it is noted that the invention does not only relate to wet vacuum cleaners, but also to other types of vacuum cleaners such as dry vacuum cleaners only having a dry cleaning function and wet/dry vacuum cleaners having a dry cleaning function besides a wet cleaning function. The vacuum cleaner according to the invention may be one of a vacuum cleaner that is commonly referred to as canister vacuum cleaner, a vacuum cleaner that is commonly referred to as upright vacuum cleaner, a vacuum cleaner that is commonly referred to as robotic vacuum cleaner, and a vacuum cleaner that is commonly referred to as sweeper.

The wet vacuum cleaner 100 is configured to be used for the purpose of subjecting a surface 10 such as a floor surface to a wet cleaning action. FIG. 1 shows the vacuum cleaner 100 in a normal, operational orientation relative to the surface 10 to be cleaned. The use in the present text of a term having an orientation aspect is to be understood in relation to this normal, operational orientation of the vacuum cleaner 100 relative to the surface 10 to be cleaned, wherein it is assumed that the surface 10 is at a bottom position and the vacuum cleaner 100 is placed on the surface 10.

At a side that is supposed to face the surface 10 during operation of the vacuum cleaner 100, the vacuum cleaner 100 comprises a suction head 101 accommodating two brushes 20 which are configured to interact with the surface 10 during operation of the vacuum cleaner 100. In the following, it is assumed that each of the brushes 20 is provided in the form of a roller that is rotatable about a rotation axis 21 that is defined by a central longitudinal axis of the roller, and that each of the brushes 20 comprises a core element 22 and flexible microfiber elements 23 arranged on the core element 22, which does not alter the fact that other embodiments of the brushes 20 are possible as well. The brushes 20 may be identical, but this is not necessary in the context of the invention. As indicated in FIG. 1 by means of curved arrows depicted at the position of the brushes 20, the brushes 20 are arranged so as to be rotatable in opposite directions with respect to each other about their respective rotation axes 21. In the framework of the invention, the suction head 101 may accommodate another number of brushes 20, wherein it is particularly to be noted that having just a single brush 20 is a feasible alternative option. The suction head 101 comprises a housing 30 that is configured to partially cover the brushes 20.

Besides the suction head 101, the vacuum cleaner 100 comprises a body portion 102 that is configured to be taken hold of by a user of the vacuum cleaner 100. Preferably, the suction head 101 and the body portion 102 are removably couplable to each other. The body portion 102 can be shaped in any appropriate way. The outline of the body portion 102 as shown in FIG. 1 is of a diagrammatical nature only. It is practical if the body portion 102 comprises a handle so that a user can easily take hold of the body portion 102 and move the vacuum cleaner 100 across the surface 10 to be cleaned as desired. Although this is not illustrated in the figures, it is practical if the suction head 101 comprising a supporting mechanism that is configured to enable the suction head 101 to be supported on the surface 10 to be cleaned and to be moved back and forth on the surface 10. Such a supporting mechanism may comprise a pair of wheels, for example.

For the purpose of driving the brushes 20 during operation of the vacuum cleaner 100, the vacuum cleaner 100 is equipped with a suitable drive mechanism (not shown), which is an electric drive mechanism in practical situations. For the purpose of powering the drive mechanism and probably also other components of the vacuum cleaner 100, the vacuum cleaner 100 may be connectable to the mains and/or may be equipped with a suitable battery arrangement. Preferably, the vacuum cleaner 100 is a cordless device comprising a rechargeable battery arrangement, in which case it may further be practical if the vacuum cleaner 100 is part of a set including a charging dock besides the vacuum cleaner 100. Such a set may also include a flushing tray that can be used for the purpose of cleaning the brushes 20. In case the vacuum cleaner 100 is not equipped with a battery, a simple dock that is without charging ability may be provided for receiving and holding the vacuum cleaner 100 while the vacuum cleaner 100 is not being operated.

The body portion 102 of the vacuum cleaner 100 includes a liquid reservoir 40 that serves for containing a liquid such as water or a mixture of water and a cleaning agent, and a liquid supply mechanism 41 that serves for supplying the liquid to a wetting arrangement 42 of the suction head 101 during operation of the vacuum cleaner 100. The liquid supply mechanism 41 may comprise any suitable type of pump arrangement, for example, or may be configured to enable displacement of the liquid as desired under the influence of gravity. In general, the wetting arrangement 42 of the suction head 101 may be configured to enable a supply of liquid to at least one area of the surface 10 to be cleaned and/or at least one area in the suction head 101, such as an area where the brushes 20 are located. FIG. 1 illustrates the option of the wetting arrangement 42 of the suction head 101 being configured to enable a supply of liquid to at least one area of the surface 10 to be cleaned. In the shown example, the suction head 101 comprises an elongated intermediate component 25 that is located in an area between the brushes 20 and that comprises two concavely curved portions configured to cover portions of the brushes 20, and the wetting arrangement 42 comprises a conduit system 43 that is partially arranged in the elongated intermediate component 25 and that is configured to transport the liquid and to let out the liquid to the at least one area of the surface 10. In FIG. 1, the liquid reservoir 40, the liquid supply mechanism 41 and the wetting arrangement 42 of the suction head 101 are indicated by means of dotted lines. It is practical if the liquid reservoir 40 is removably coupled to the body portion 102 so that a user is enabled to separate the liquid reservoir 40 from the body portion 102 when it is desired to take the liquid reservoir 40 to a place where the liquid reservoir 40 is to be filled with liquid.

It is practical if, at the position of a top side thereof, the elongated intermediate component 25 is suspended from a portion of the housing 30 of the suction head 101. Covering as much as possible of the brushes 20, preferably at a very close range, is beneficial when it comes to effectively invoking the suction force in the suction head 101. The elongated intermediate component 25 may be an integral part of the housing 30 or may be provided as a separate component that could be removably coupled to another component of the housing 30 so as to allow repair or cleaning, for example.

The body portion 102 of the vacuum cleaner 100 further includes a dirt reservoir 50 that serves for receiving and accumulating wet dirt 11 that is picked up from the surface 10 by the brushes 20 during operation of the vacuum cleaner 100. The dirt reservoir 50 can be configured in numerous ways as conventionally available for accumulating wet dirt from the incoming dirt 11 that is picked up from the surface 10 such as for instance a cyclonic arrangement or a tube-in-cup arrangement. The body portion 102 includes a vacuum mechanism 60 configured to create underpressure that is functional to enable transport of the dirt 11 from the area where the brushes 20 are located to the dirt reservoir 50 in the body portion 102, through an outlet opening 31 in a surface 32 of the housing 30 facing the brushes 20 and a suction channel 51 extending from the outlet opening 31 to the dirt reservoir 50.

Basic aspects of the way in which the wet vacuum cleaner 100 is operated are as follows. During operation, the brushes 20 are driven so as to rotate and the liquid supply mechanism 41 is activated so as to supply liquid to the wetting arrangement 42 of the suction head 101 so that liquid may be let out to the surface 10 to be cleaned. Any stains as may be present on an area of the surface 10 that is within reach of the brushes 20 are detached under the influence of the liquid and agitation by the brushes 20, and dirt particles and dust as may be present on the area of the surface 10 are removed along with the liquid and conveyed to the dirt reservoir 50, passing through the outlet opening 31 and the suction channel 51 in the process. The dirt 11 is picked up from the surface 10 by tip portions of the microfiber elements 23 of the brushes 20 and is flung away from the tip portions as the brushes 20 rotate, at a position where the tip portions move out of contact to the surface 10.

As illustrated in FIG. 1, the vacuum cleaner 100 may be equipped with a user interface 70, which user interface 70 may include an on/off button 71, for example. The vacuum cleaner 100 may further comprise a controlling system 80 including a microcontroller that is programmed to put the brushes 20 in motion and to activate both the liquid supply mechanism 41 and the vacuum mechanism 60 in reaction to input received from the user through the user interface 70 to that end.

FIGS. 2-5 serve to illustrate aspects of a suction head 101 according to an embodiment of the invention, especially aspects of the housing 30 of the suction head 101, without showing the brushes 20 for the sake of clarity. As already mentioned in the foregoing, the surface 32 of the housing 30 facing the brushes 20 is provided with an outlet opening 31. Further, with reference to FIGS. 2 and 3, it is noted that the housing 30 includes a coupling area 33 that is configured to enable coupling of the housing 30 to the assembly of the suction channel 51, the dirt reservoir 50 and the vacuum mechanism 60 in the body portion 102 of the vacuum cleaner 100. The outlet opening 31 is in fluid communication with this coupling area 33.

Figure 2:
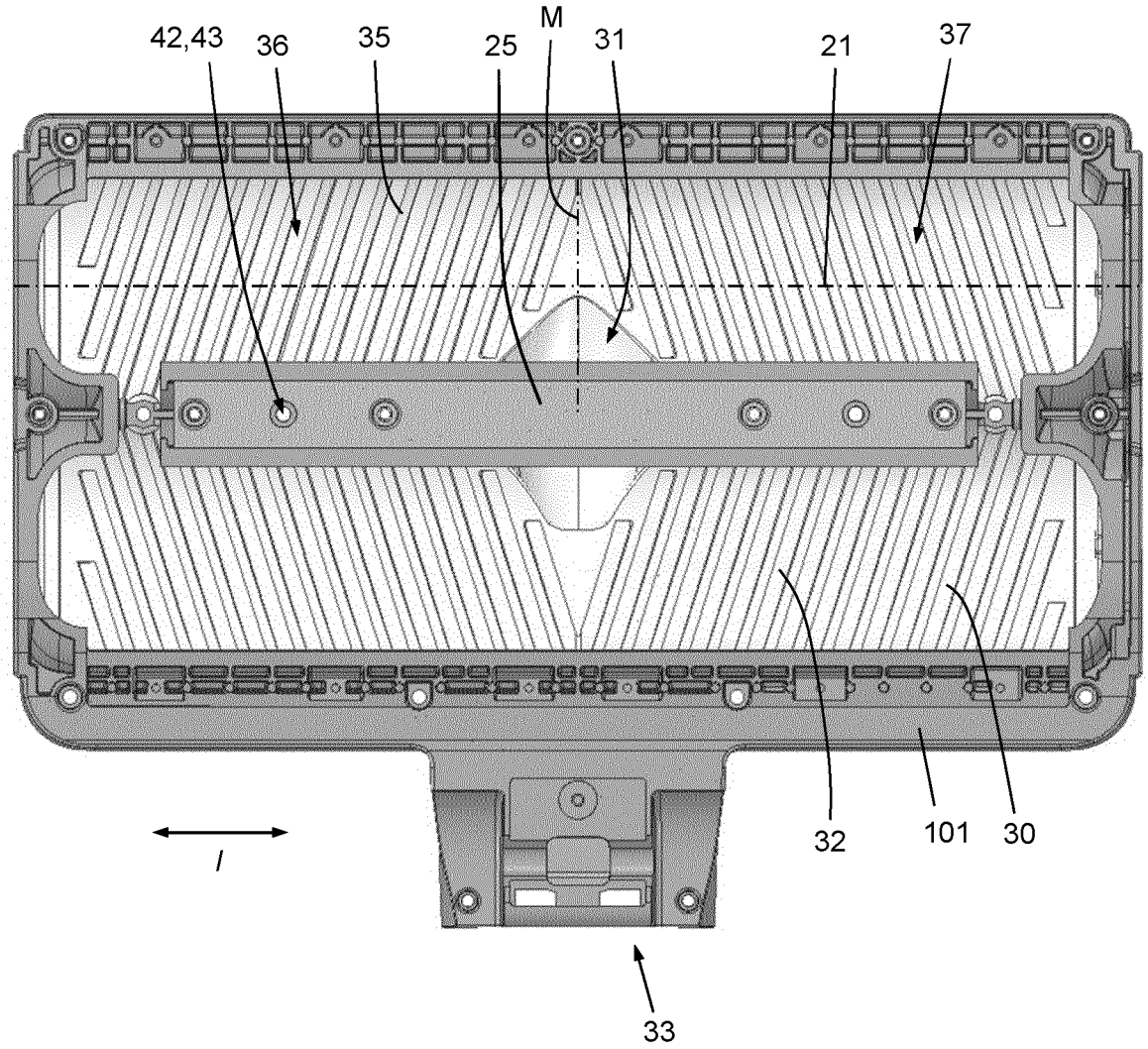
Figure 3:
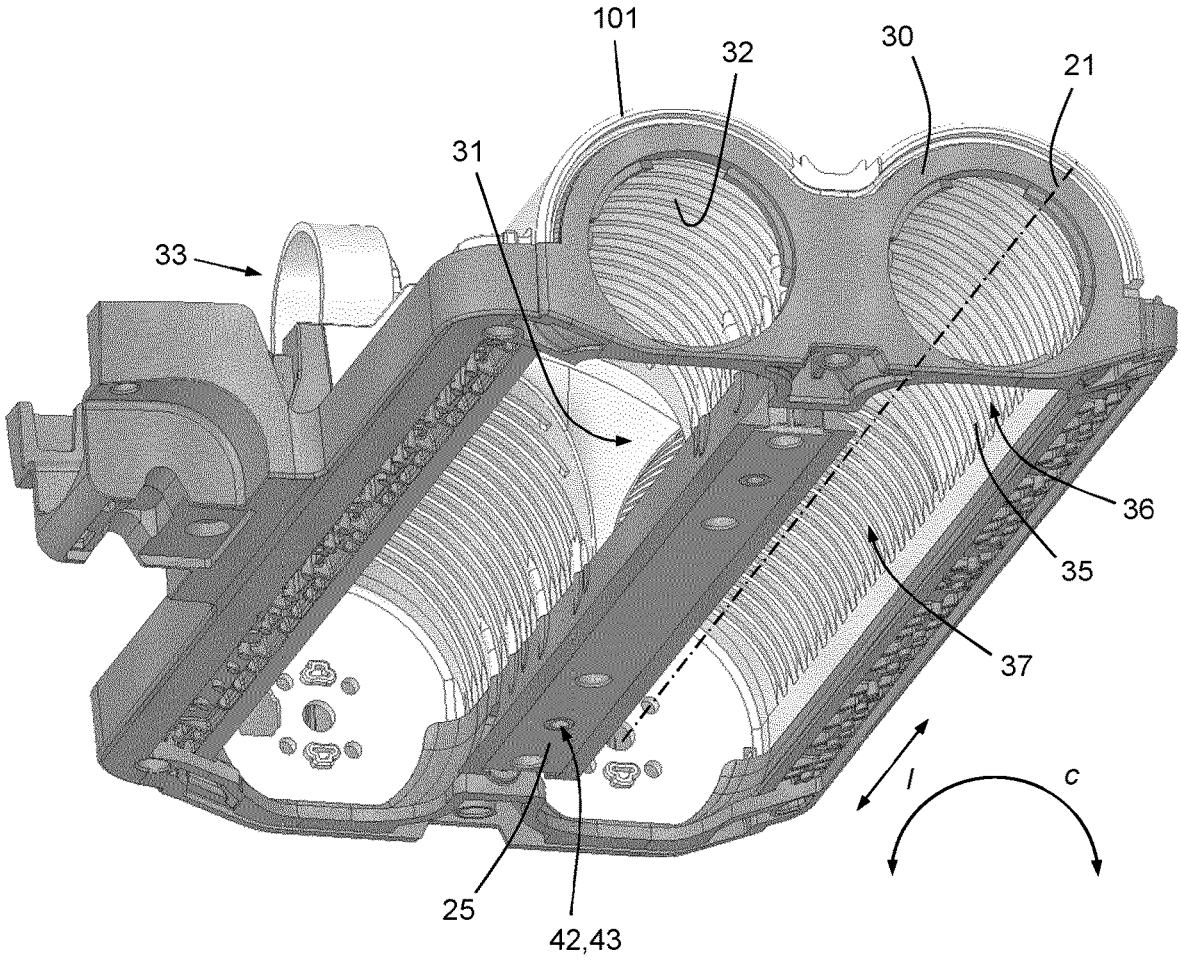

A further feature of the surface 32 of the housing 30 facing the brushes 20 is that the surface 32 is provided with a plurality of grooves 35. The housing 30 can be made of a plastic material, for example, in which case the grooves 35 can simply be moulded into the housing 30 at the position of the surface 32 as mentioned. As seen per brush 20, the plurality of grooves 35 comprises two sets 36, 37 of grooves 35, which sets 36, 37 are located at sides of the outlet opening 31 which are opposite sides in a longitudinal direction/being the direction in which the rotation axis 21 of the brush 20 extends. Each of the sets 36, 37 of grooves 35 includes grooves 35 which are oriented with a circumferential component about the rotation axis 21 and with an axial component in the longitudinal direction l. The latter can best be seen in FIG. 2. As seen in the same circumferential direction c about the rotation axis 21, a direction of the axial component of the grooves 35 of the one set 36, 37 of grooves 35 is opposite to a direction of the axial component of the grooves 35 of the other set 36, 37, as can also best be seen in FIG. 2. In the shown example, the grooves 35 are arranged like segments of a helical winding about the rotation axis 21 of the brush 20 leading towards the outlet opening 31 as seen in the direction of rotation of the brush 20 about the rotation axis 21. Further, in the shown example, the two sets 36, 37 of grooves 35 are mirror-symmetrical relative to an imaginary mirror plane M that is perpendicular to the rotation axis 21 of the brush 20 and that intersects the outlet opening 31, as indicated in FIG. 2.

On the basis of the presence of the grooves 35 in the surface 32 of the housing 30 facing the brushes 20, the invention provides a way of generating a force for driving dirt particles caught by the brushes 20 to the outlet opening 31 that is arranged to provide access to the suction channel 51. In the process, use is made of the flow induced by the rotating brushes 20 in combination with the groove geometry on the surface 32 as mentioned. In the case of relatively large dirt particles or fluffy material, it may further be so that the rotating brushes 20 have a wiping effect on such type of dirt following from contact to the dirt. In any case, in view of the fact that mechanically created force is highly efficient, the power requirement for doing so is only minimal.

In the following, notable aspects of the grooves 35 and the pattern of the grooves 35 in the surface 32 of the housing 30 facing the brushes 20 will be addressed. The notable aspects include features of a cross-sectional shape of the grooves 35 and the way in which the grooves 35 overlap in the pattern.

Figure 4:
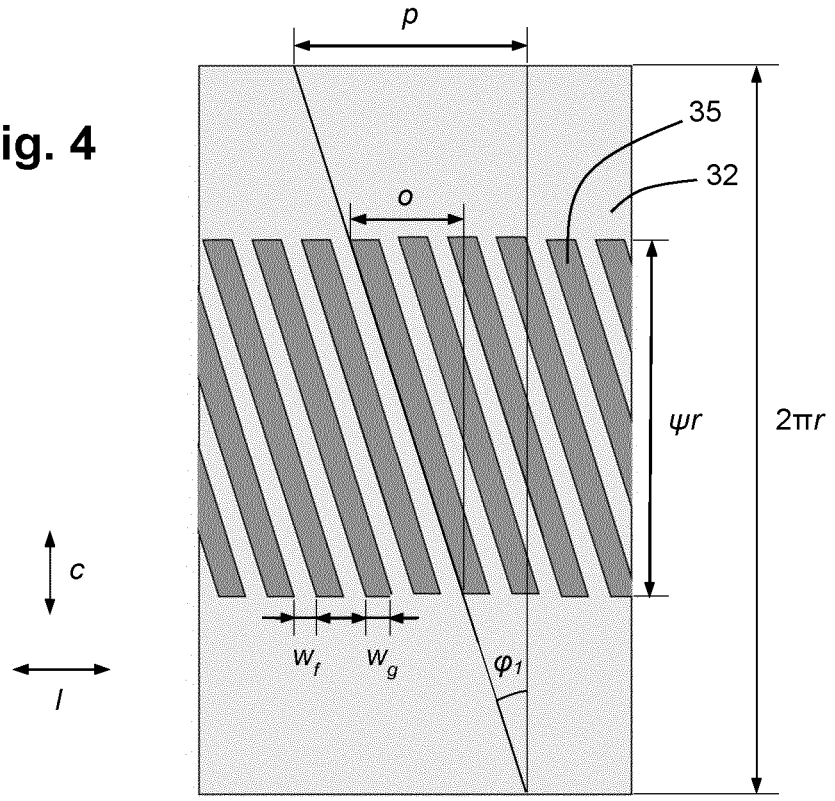

With reference to FIG. 4, it is noted that an overlap length o of the pattern of the grooves 35 is defined as the dimension of the groove 35 in the longitudinal direction l, from the one end of a groove 35 to the other. The overlap length o is calculated on the basis of a pitch p of the pattern and an application angle $\psi$ of the pattern in the circumferential direction c, as follows: $o=(\psi/2\pi)\cdot p$. The overlap length o and the application angle $\psi$ determine an angle $\varphi_1$ in the groove pattern, as follows: $\varphi_1=\tan^{-1}(o/\psi r)$, wherein r is the radius of the curved surface 32 of the housing 30 facing the brushes 20. The angle $\varphi_1$ determines an important friction angle defining the efficiency of the drive mechanism of a captured dirt particle. In this respect, it is noted that the friction angle $\varphi_1$ is the average angle, and that the groove 35 is not necessarily shaped as a segment of a helical winding. In the shown example of the grooves 35 being arranged like segments of a helical winding about the rotation axis 21 of the brush 20, the overlap length o is an important aspect as for the purpose of transporting the dirt in the longitudinal direction l, it is on the basis of overlap that dirt particles are enabled to disengage at the end of one groove 35 and to be picked up again and introduced in a next groove 35, i.e. a groove 35 that it closer to the outlet opening 31.

Figure 5:
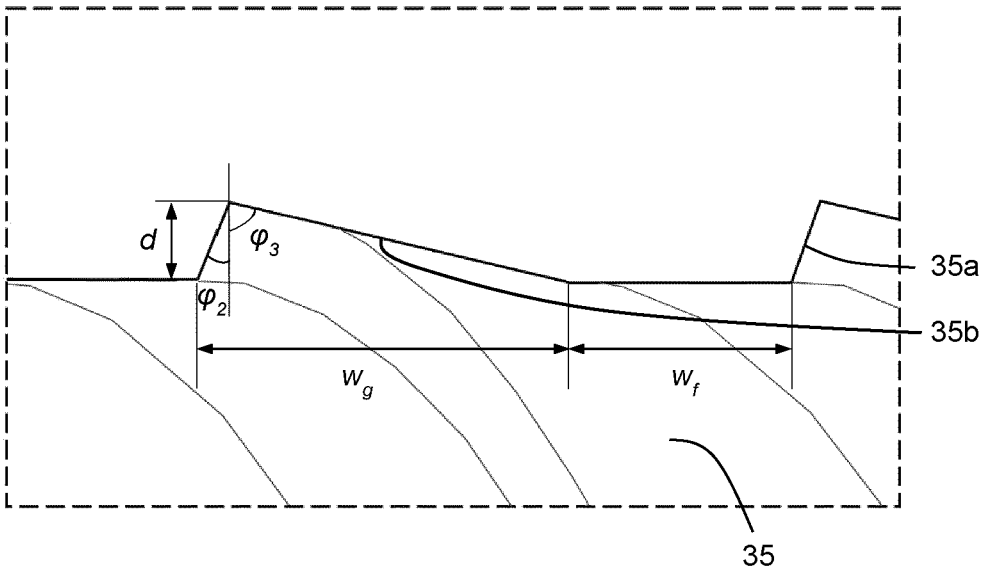
FIG. 5 illustrates a cross-sectional shape of the grooves.

With reference to FIG. 5, it is noted that it is advantageous if the cross-sectional shape of the groove 35 is a saw tooth shape as shown. In general, in that case, the cross-section geometry is characterized by i) a groove width $w_g$, ii) an angle $\varphi_2$ of the steep saw tooth side 35*a*, that constitutes a factor in driving a dirt particle to the outlet opening 31, iii) an angle $\varphi_3$ of the shallow saw tooth side 35*b*, iv) a groove depth d, and v) a flat surface width $w_f$, i.e. the width of the surface separating the individual grooves 35, at the nominal diameter of the curved surface 32 of the housing 30 facing the brushes 20. It is noted that there is redundancy between the groove width $w_g$, the groove depth d, the angle $\varphi_2$ of the steep saw tooth side 35*a*, and the angle $\varphi_3$ of the shallow saw tooth side 35*b*.

A coarse dirt particle that has been flung onto the surface 32 of the housing 30 facing the brushes 20 is subsequently subjected to forces following from the interaction with the groove pattern in the surface 32 on the one hand and the influence of a brush force induced by the respective rotating brush 20 on the other hand. The steep saw tooth side 35*a* of the groove 35 induces a reaction (normal) force on the dirt particle and a friction force as a result of the brush force on the dirt particle, and a force necessary to accelerate and move the dirt particle in the radial direction. The shallow saw tooth side 35*b* of the groove 35 induces a similar reaction (normal) force on the dirt particle and a friction force as a result of the brush force on the dirt particle, and a force necessary to accelerate and move the dirt particle in the radial direction.

The various parameters determining the pattern of the grooves 35 are chosen so as to prevent dirt particles from escaping from a groove 35, to minimize the energy needed to transport a dirt particle towards the outlet opening, to optimize the time that the dirt particles move through a set 36, 37 of grooves 35, and/or to minimize the extent that the suction head 101 can get polluted by fine dust. In this respect, the following parameters are addressed:

- the groove width $w_g$. This parameter is the result of the angle $\varphi_2$ of the steep saw tooth side 35*a*, the angle $\varphi_3$ of the shallow saw tooth side 35*b*, and the groove depth d.
- the angle $\varphi_2$ of the steep saw tooth side 35*a*. This angle is preferably as small as possible, preventing dirt particles from escaping from the groove 35. Hence, this angle is preferably 0°, but for practical reasons such as manufacturing requirements, this angle can be larger, wherein a maximum of 45° is practical. Various values of this angle may be applicable at different positions in the pattern of grooves 35.
- the angle $\varphi_3$ of the shallow saw tooth side 35*b*. This angle is preferably between 45° and 85°. Smaller values result in a groove 35 that easily stores dirt particles, in which case the dirt particles are difficult to remove under the influence of the effect of air speed and liquid droplets induced by the rotating brush 20, i.e. under the influence of a shearing force of air with liquid droplets created by brush rotation. The shearing force of air with water droplets created by brush rotation. Larger values results in a larger dead volume in the surface 32 of the housing 30 facing the brushes 20, which also increases sensitivity to pollution and in larger groove widths $w_g$. A larger groove width $w_g$ automatically results in a larger overlap length o.
- the groove depth d. This is determined by the choice of the optimization in particle size to be transported. Larger groove depths d are suitable for larger dirt particles, enabling a dirt particle to have a contact point on the steep saw tooth side 35*a*. A maximum groove depth d of 4 mm is practical. An effect of having a larger groove depth d is storage of smaller dirt particles in the grooves 35, although this effect is counteracted to some extent on the basis of the fact that very small dirt particles are transported by the flows of liquid and air. An effect of having a smaller groove depth d is less efficient transport of larger dirt particles. A minimum groove depth d of 0.5 mm is practical.
- the flat surface width $w_f$. This width is best maximized to prevent pollution of the housing 30 by smaller dirt particles. However, this width is limited by the maximum value of the friction angle $\varphi_1$. The following is applicable: $0<w_f<2\psi r-w_g$, resulting in a maximum average friction angle $\varphi_1\approx 63°$.
- the overlap length o. This length is chosen to never be smaller than the sum of the flat surface width $w_f$ and the groove width $w_g$. Because for some dirt particles the groove 35 cannot be 100% efficient, the overlap length o can be chosen up to ten times the sum of the flat surface width $w_f$ and the groove width $w_g$.
- the application angle $\psi$. It is most efficient to choose this angle to be as large as possible, over the entire radius of the surface 32 of the housing 30 facing the brushes 20. For practical reasons such as manufacturing requirements or features in the suction head 101, this angle can be chosen from a range of 30° to 270°.

Figure 6:
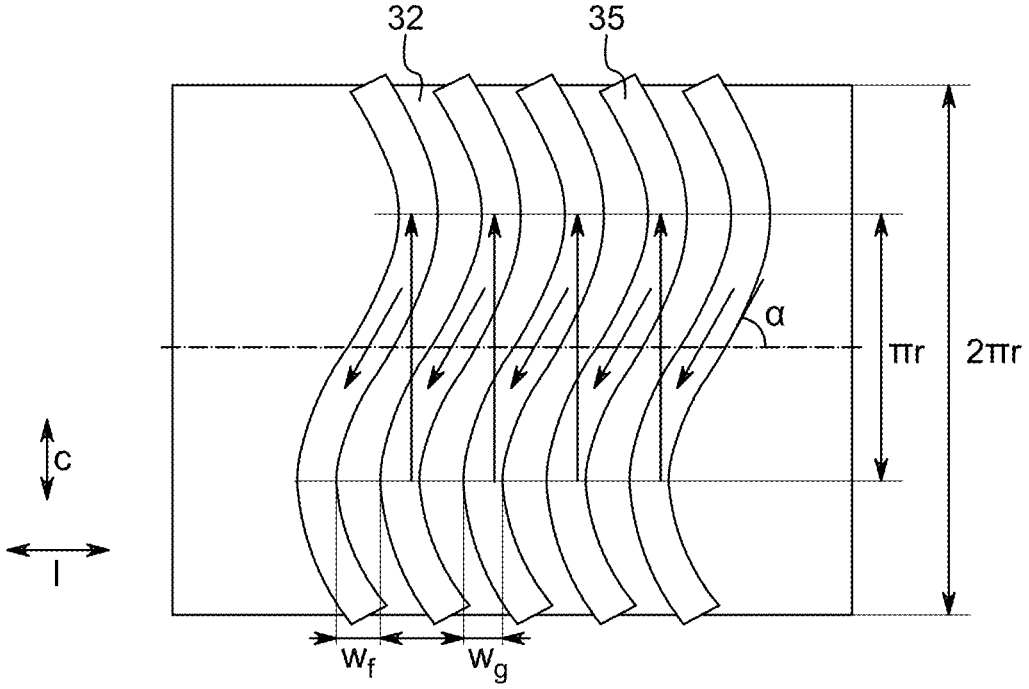
FIG. 6 illustrates how dirt particles travel from one groove to another and inside grooves in a case of the grooves being arranged like segments of an elliptical winding, and FIGS. 7 and 8 diagrammatically show perspective views of a helical winding and an elliptical winding, respectively.

FIG. 6 relates to the option of the grooves 35 being arranged like segments of an elliptical winding about the rotation axis 21 of the brush 20 leading towards the outlet opening 31 as seen in a direction of rotation of the brush 20 about the rotation axis 21. In the figure, a view of a complete elliptical winding that has been cut at one side along its length and rolled open, and that has a total length $2\pi r$ in the circumferential direction c, is diagrammatically shown. The length of the grooves 35 in the circumferential direction c is chosen to be half of the total length, i.e. $\pi r$, and the groove width $w_g$ and the distance $w_f$ between individual grooves 35 in the longitudinal direction l are chosen such that a dirt particle can travel from one groove 35 to another in the circumferential direction c, perpendicular to the longitudinal direction l, at a given angle $\alpha$ of the orientation of the grooves 35 relative to the longitudinal direction l. In this respect, it is noted that, assuming that the length of the grooves 35 in the circumferential direction c is $\pi r$ as indicated, a dirt particle can always be caught in a next groove 35 if the product of the radius r and tan $\alpha/2$ is larger than the sum of the groove width $w_g$ and the distance $w_f$ between individual grooves 35 in the longitudinal direction l.

As explained earlier, dirt particles disengage at the end of one groove 35 and are picked up again and introduced in a next groove 35 by means of the rotating brush 20. The path followed by the dirt particles under the influence of the rotation movement of the brush 20 outside of the grooves 35, which path is along the surface 10 to be cleaned, is typically oriented perpendicular to the longitudinal direction l, as indicated by vertical arrows in FIG. 6. As soon as the dirt particles are introduced in a groove 35, they start following the path dictated by the groove 35, as indicated by arrows extending in the respective grooves 35 in FIG. 6. Thus, during the times that the dirt particles are outside of the grooves 35, the dirt particles are moved from one groove 35 to another without displacement in the longitudinal direction l, whereas during the times that the dirt particles are inside the grooves 35, the movement of the dirt particles does involve displacement in the longitudinal direction l so that eventually the dirt particles can reach the outlet opening 31.

Figure 7:
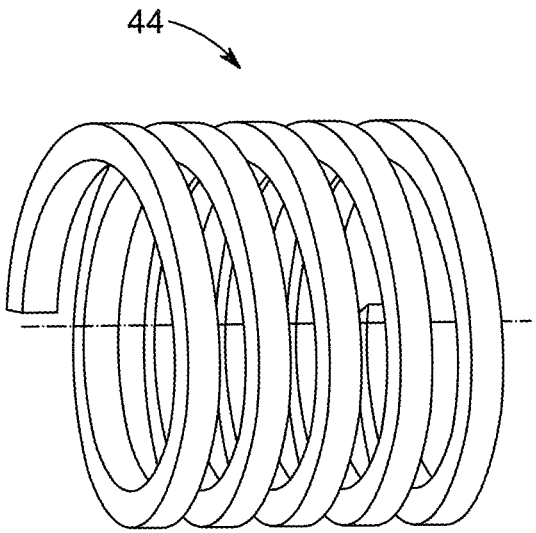
Figure 8:
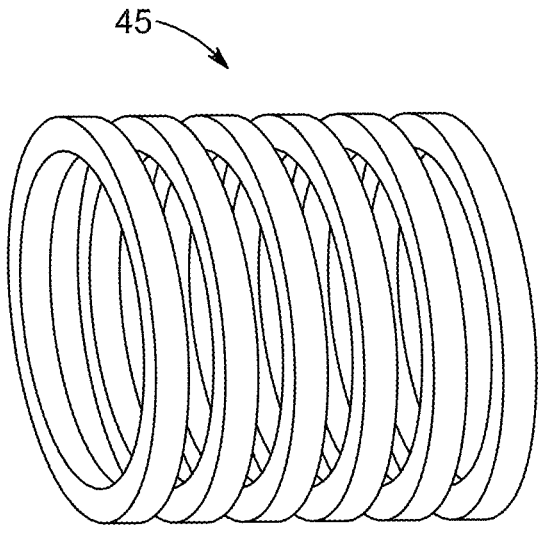

The differences between a helical winding and an elliptical winding can be readily seen when a comparison of FIGS. 7 and 8 is made. As explained earlier and as shown in FIG. 7, a helical winding 44 can be regarded as a continuous winding comprising loops which are oriented according to a wire wound around a cylinder in an advancing fashion as it were, i.e. as a winding having a screw-like appearance. As explained earlier and as shown in FIG. 8, an elliptical winding 45 can be regarded as a winding of which the loops are oriented according to parallel slices of a cylinder as it were, taken at an angle relative to the longitudinal axis of the cylinder, so that the loops are separate from each other.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. In a suction head 101 comprising a housing 30 and at least one rotatable brush 20 that is configured to interact with a surface 10 to be cleaned, a surface 32 of the housing 30 facing the brush 20 is provided with a plurality of grooves 35 for facilitating transport of dirt towards an outlet opening 31 in the surface 32 from any position along the brush 20, under the influence of the rotation movement of the brush 20 realized during operation. The plurality of grooves 35 comprises two sets 36, 37 of grooves 35, which are located at opposite sides of the outlet opening 31. Taking a rotation axis 21 of the brush 20 as a reference, each of the sets 36, 37 of grooves 35 includes grooves 35 having a circumferential component and an axial component, wherein, as seen in the same circumferential direction c, a direction of the axial component of the grooves 35 is opposite for the two sets 36, 37 of grooves 35.

The invention claimed is:

1. A suction head configured to be applied in a vacuum cleaner and to perform a cleaning action on a surface, the suction head comprising:

a housing, and at least one brush that is arranged in the housing to be rotatable about a rotation axis, wherein the at least one brush is configured to interact with the surface to be cleaned, wherein the housing is configured to expose a portion of the at least one brush to the surface to be cleaned and to cover another portion of the at least one brush, wherein a surface of the housing facing the at least one brush is provided with an outlet opening that is configured to be in communication with an air suction source configured to invoke a flow of air in a direction away from an area of the housing where the at least one brush is located, through the outlet opening, wherein the surface of the housing facing the at least one brush is further provided with a plurality of grooves, wherein the plurality of grooves comprises two sets of grooves, which are located at sides of the outlet opening, wherein the sides of the outlet opening are opposite to each other in a longitudinal direction (l), the longitudinal direction (l) being the direction in which the rotation axis of the at least one brush extends, wherein, in the longitudinal direction (l), the plurality of grooves covers most or all of the at least one brush, wherein each of the two sets of grooves includes grooves which are oriented with a circumferential component about the rotation axis and with an axial component in the longitudinal direction (l), wherein, as seen in the same circumferential direction (c) about the rotation axis, a direction of an axial component of the grooves of the one set of grooves is opposite to a direction of the axial component of the grooves of the other set, and wherein a depth (d) of the grooves is in range of 0.5 mm to 4 mm.

2. The suction head of claim 1, wherein, in the longitudinal direction (l), the outlet opening is dimensioned to cover only a portion of a dimension of the at least one brush.

3. The suction head of claim 1, wherein the surface of the housing facing the at least one brush covers the at least one brush along an angular distance of at least 180° in the circumferential direction (c), and wherein the plurality of grooves covers most of the surface of the housing facing the at least one brush in the circumferential direction (c).

4. The suction head of claim 1, wherein the two sets of grooves are mirror-symmetrical relative to an imaginary mirror plane (M) that is perpendicular to the rotation axis of the at least one brush, and wherein the imaginary mirror plane (M) intersects the outlet opening.

5. The suction head of claim 1, wherein at least one of the two sets of grooves includes grooves which are arranged as segments of one of a helical winding about the rotation axis of the at least one brush leading towards the outlet opening as seen in a direction of rotation of the at least one brush about the rotation axis and an elliptical winding about the rotation axis of the at least one brush leading towards the outlet opening as seen in the direction of rotation of the at least one brush about the rotation axis.

6. The suction head of claim 1, wherein individual grooves are configured to cover a distance (o) in the longitudinal direction (l) that is larger than the sum of a dimension ($w_g$) of an individual groove in the longitudinal direction (l) and a distance ($w_f$) between the individual grooves in the longitudinal direction (l).

7. The suction head of claim 6, wherein the individual grooves have a saw tooth geometry with a steep saw tooth side and a shallow saw tooth side.

8. The suction head of claim 7, wherein, in the cross-section of each of the individual grooves, the steep saw tooth side is at an angle ($\varphi_2$) that is in a range of 0° to 45° relative to an imaginary reference plane perpendicular to the longitudinal direction (l) and/or the shallow saw tooth side is at an angle ($\varphi_3$) that is in a range of 45° to 85° relative to the imaginary reference plane perpendicular to the longitudinal direction (l).

9. The suction head of claim 6, wherein the distance ($w_f$) between the individual grooves in the longitudinal direction (l) is in a range between zero and a distance covered by the groove in the circumferential direction (c) minus the dimension ($w_g$) of each of the individual grooves in the longitudinal direction (l).

10. The suction head of claim 1, wherein an operational shape of the at least one brush is generally the shape of a cylinder having a circular periphery.

11. The vacuum cleaner, comprising the suction head of claim 1, wherein the suction head comprises a wetting arrangement that is configured to enable a supply of liquid to at least one area of the surface to be cleaned and/or at least one area in the suction head.

12. A cordless vacuum cleaner, comprising the suction head of claim 1.

13. The suction head of claim 1, wherein, in the longitudinal direction, the outlet opening has a substantially central positioning relative to the at least one brush.

14. The suction head of claim 1, wherein a distance between the surface of the housing facing the at least one brush and an operational outline of the at least one brush is a distance in a range of 0 mm to 2 mm, in areas of the surface of the housing facing the at least one brush outside of the grooves.

* * * * *